US007106255B2

(12) United States Patent
du Toit

(10) Patent No.: US 7,106,255 B2
(45) **Date of Patent: *Sep. 12, 2006**

(54) STACKED PATCH ANTENNA AND METHOD OF OPERATION THEREFORE

(75) Inventor: Cornelis Frederik du Toit, Ellicott City, MD (US)

(73) Assignee: Paratek Microwave, Inc., Columbia, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/914,580

(22) Filed: Aug. 9, 2004

(65) Prior Publication Data

US 2005/0116862 A1 Jun. 2, 2005

Related U.S. Application Data

(60) Provisional application No. 60/493,832, filed on Aug. 8, 2003.

(51) Int. Cl.
*H01Q 1/24* (2006.01)

(52) U.S. Cl. ..... 343/700 MS

(58) Field of Classification Search ..... 343/700 MS
See application file for complete search history.

(56) References Cited

U.S. PATENT DOCUMENTS

| | | | | |
|---|---|---|---|---|
| 5,241,321 | A * | 8/1993 | Tsao | 343/700 MS |
| 5,312,790 | A | 5/1994 | Sengupta et al. | 501/137 |
| 5,427,988 | A | 6/1995 | Sengupta et al. | 501/137 |
| 5,438,697 | A * | 8/1995 | Fowler et al. | 455/347 |
| 5,486,491 | A | 1/1996 | Sengupta et al. | 501/137 |
| 5,519,406 | A * | 5/1996 | Tsukamoto et al. | 343/700 MS |
| 5,593,495 | A | 1/1997 | Masuda et al. | 117/4 |
| 5,635,433 | A | 6/1997 | Sengupta | 501/137 |
| 5,635,434 | A | 6/1997 | Sengupta | 501/138 |
| 5,640,042 | A | 6/1997 | Koscica et al. | 257/595 |
| 5,693,429 | A | 12/1997 | Sengupat et al. | 428/699 |
| 5,694,134 | A | 12/1997 | Barnes | 343/700 |
| 5,766,697 | A | 6/1998 | Sengupta et al. | 427/585 |
| 5,830,591 | A | 11/1998 | Sengupta et al. | 428/701 |
| 5,846,893 | A | 12/1998 | Sengupta et al. | 501/137 |
| 5,886,867 | A | 3/1999 | Chivukula et al. | 361/311 |
| 5,990,766 | A | 11/1999 | Zhang et al. | 333/205 |
| 6,074,971 | A | 6/2000 | Chiu et al. | 501/139 |
| 6,121,931 | A | 9/2000 | Levi | |
| 6,255,995 | B1 | 7/2001 | Asano et al. | |
| 6,323,810 | B1 * | 11/2001 | Poilasne et al. | 343/700 MS |
| 6,346,914 | B1 * | 2/2002 | Annamaa | 343/700 MS |
| 6,377,142 | B1 | 4/2002 | Chiu et al. | 333/238 |
| 6,377,217 | B1 | 4/2002 | Zhu et al. | 343/700 |
| 6,377,440 | B1 | 4/2002 | Zhu et al. | 361/311 |

(Continued)

OTHER PUBLICATIONS

PCT International Search Report for International Application No. PCT/US04/025875 dated Apr. 14, 2006.

*Primary Examiner*—Tho Phan
(74) *Attorney, Agent, or Firm*—James S. Finn

(57) ABSTRACT

A stacked antenna comprising a first patch including at least one slot-like part thereon, a second patch including at least one strip-like part thereon; and wherein the at least one slot-like part of the first patch at least partially crosses over or partially crosses under the at least one strip-like part of the second patch thereby forming a coupling region. The at least one slot-like part may be formed by at least one notch in the first patch and the at least one strip-like part may be formed by at least one hole in the second patch.

20 Claims, 8 Drawing Sheets

U.S. PATENT DOCUMENTS

| | | | | |
|---|---|---|---|---|
| 6,404,614 | B1 | 6/2002 | Zhu et al. | 361/277 |
| 6,492,883 | B1 | 12/2002 | Liang et al. | 333/132 |
| 6,514,895 | B1 | 2/2003 | Chiu et al. | 501/137 |
| 6,525,630 | B1 | 2/2003 | Zhu et al. | 333/205 |
| 6,531,936 | B1 | 3/2003 | Chiu et al. | 333/164 |
| 6,535,076 | B1 | 3/2003 | Partridge et al. | 333/17.1 |
| 6,538,603 | B1 | 3/2003 | Chen et al. | 342/372 |
| 6,556,102 | B1 | 4/2003 | Sengupta et al. | 333/161 |
| 6,590,468 | B1 | 7/2003 | du Toit et al. | 333/17.3 |
| 6,597,265 | B1 | 7/2003 | Liang et al. | 333/204 |
| 6,806,831 | B1 * | 10/2004 | Johansson et al. | 343/700 MS |

* cited by examiner (a) Parallel stacked microstrip lines (b) Parallel stacked slotlines (c) Microstrip crossing over a slotline

STACKED PATCH ANTENNA AND METHOD OF OPERATION THEREFORE

CROSS-REFERENCE TO RELATED APPLICATION

This application claims the benefit of priority under 35 U.S.C Section 119 from U.S. Provisional Application Ser. No. 60/493,832, filed Aug. 8, 2003, entitled, "Reduced Size Stacked Patch Antenna".

BACKGROUND OF THE INVENTION

In some antenna applications it may be desirable to have elements that are reduced in size. Normally, a patch element is roughly half a wavelength in extent in the medium that supports it, such as, but not limited to a dielectric substrate, which may be too large on devices where space is a premium, such as mobile phones, GPS receivers and even on air and spacecraft. Other applications may include antenna arrays, where the element spacing needs to be small (in the order of half a wavelength), such as phased array antennas.

Thus, there is strong need in the industry for a stacked antenna with broad band capabilities and improved performance characteristics in a compact size.

SUMMARY OF THE INVENTION

The present invention provides a stacked antenna, comprising a first patch including at least one slot-like part thereon, a second patch including at least one strip-like part thereon; and wherein the at least one slot-like part of the first patch at least partially crosses over or partially crosses under the at least one strip-like part of the second patch thereby forming a coupling region. The at least one slot-like part may be formed by at least one notch in the first patch and the at least one strip-like part may be formed by at least one hole in the second patch.

The stacked antenna may further comprise at least one additional patch, the at least one additional patch may include at least one slot-like part thereon if the at least one additional patch is adjacent to a patch that contains at least one strip-like part or at least one strip-like part thereon if the at least one additional patch is adjacent to a patch with at least one slot-like part thereon. Although not limited in this respect as it is anticipated that any shape or form may be utilized and is intended to be covered by the present invention, the present invention may include the first patch being a rectangular patch with at least one rectangular notch and the second patch may be a rectangular patch with a rectangular hole; or the first patch may be elliptical patch with at least one bowtie notch and the second patch may be a triangular patch with a I-shaped hole; or the first patch may be diamond shaped patch with at least one hour glass-shaped notch and the second patch may be a hexagonal patch with a dumbbell hole. A feedpoint may be associated with the first or the second patch and a ground plane may be adjacent to the first or the second patch.

The present invention further provides a method for reducing the size of a patch antenna, comprising coupling at least one patch with at least one additional patch by forming at least one slot-strip coupling region between the at least one patch and the at least one additional patch, the slot-strip coupling region formed by the at least one patch including a hole therein forming at least one strip-like portion thereon and the at least one additional patch including at least one notch therein forming at least one slot-like portion thereon, the at least one-slot like portion at least partially covering, or at least partially being covered by, the at least one strip-like portion thereby forming the coupling region.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DESCRIPTION OF THE PREFERRED EMBODIMENT

One embodiment of the present invention provides for a stacked antenna with broad band capabilities and improved performance characteristics in a compact size. Well known methods for reducing the size of planar patch antennas, may include, but are not limited to, the following:

1. Dielectric loading.
2. Using a quarter wave long short-circuited patch.
3. Introducing obstacles such as holes/slots in the patch in regions where high current flow is expected.
4. Introducing obstacles such as notches or half-slots on the edges of the patch where high current flow is expected.

The first method can be costly in the case of low frequency antennas, and can sometimes cause surface waves, causing undesirable high mutual coupling between elements in an array that may lead to blind scan angles, and which may also reduces antenna efficiency.

Figure 1:
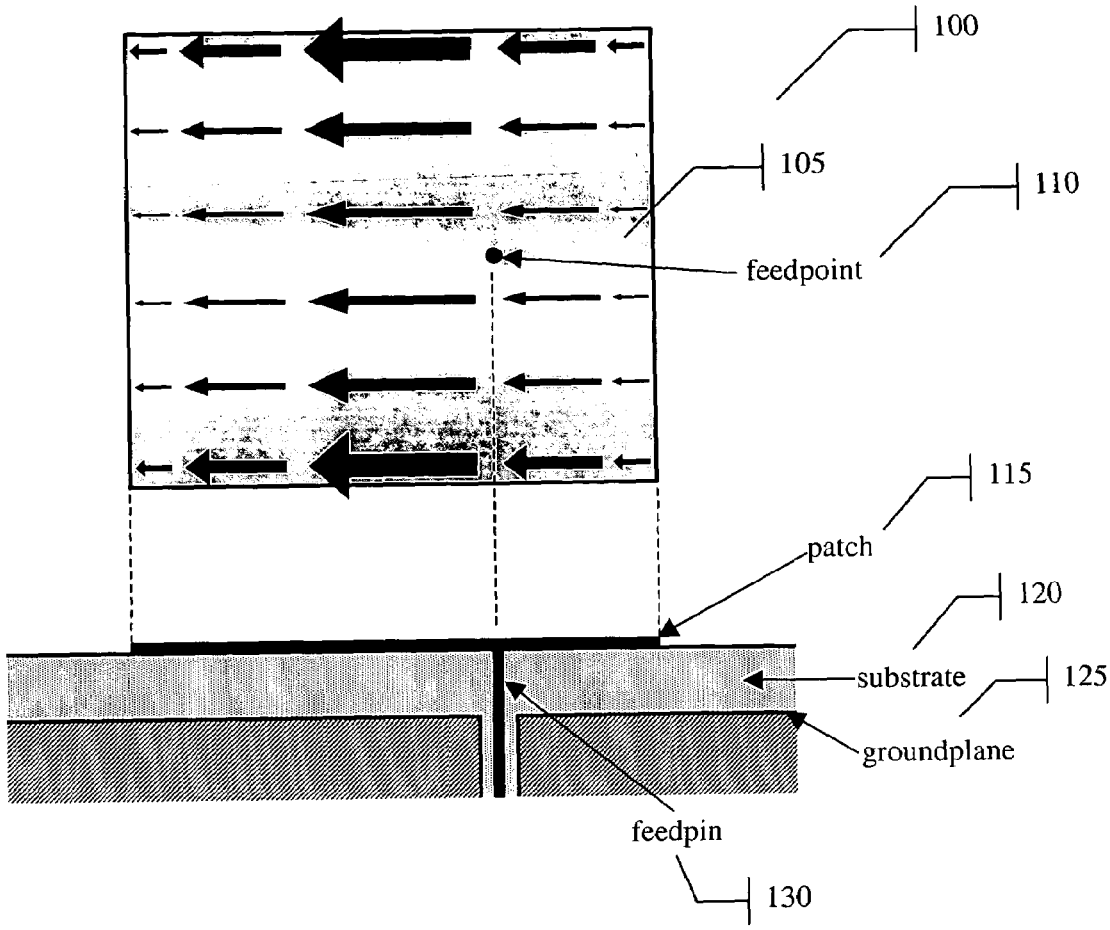
FIG. 1 depicts current flow phasor vectors on a typical rectangular patch fed by a pin are indicated by arrows.

The second method may create undesirable cross-polarization radiation due to the high currents flowing perpendicular to the patch surface currents into or out of the ground plane. FIG. 1, shown generally at 100, shows the current distribution on a typical rectangular patch antenna 105, excited for linear polarization. Patch antenna 105 is shown in its flat position 115 adjacent to substrate 120 and ground plane 125 with feed pin 130. The feedpoint of patch antenna 105 is shown at 110 and the arrows show the direction of current flow, with the arrow size reflects the current density If holes or slots and notches are placed in the path of the current, it is forced to flow around it, which creates a longer effective path length, and hence the patch size for a given resonant frequency is reduced. This explains the mechanism for the third and fourth method listed above. One advantage of these methods is that they do not require costly high permittivity dielectric substrates or short-circuiting pins or walls. Instead, they can be made from stamped metal plates, supported by inexpensive plastic spacers or foam.

Figure 2:
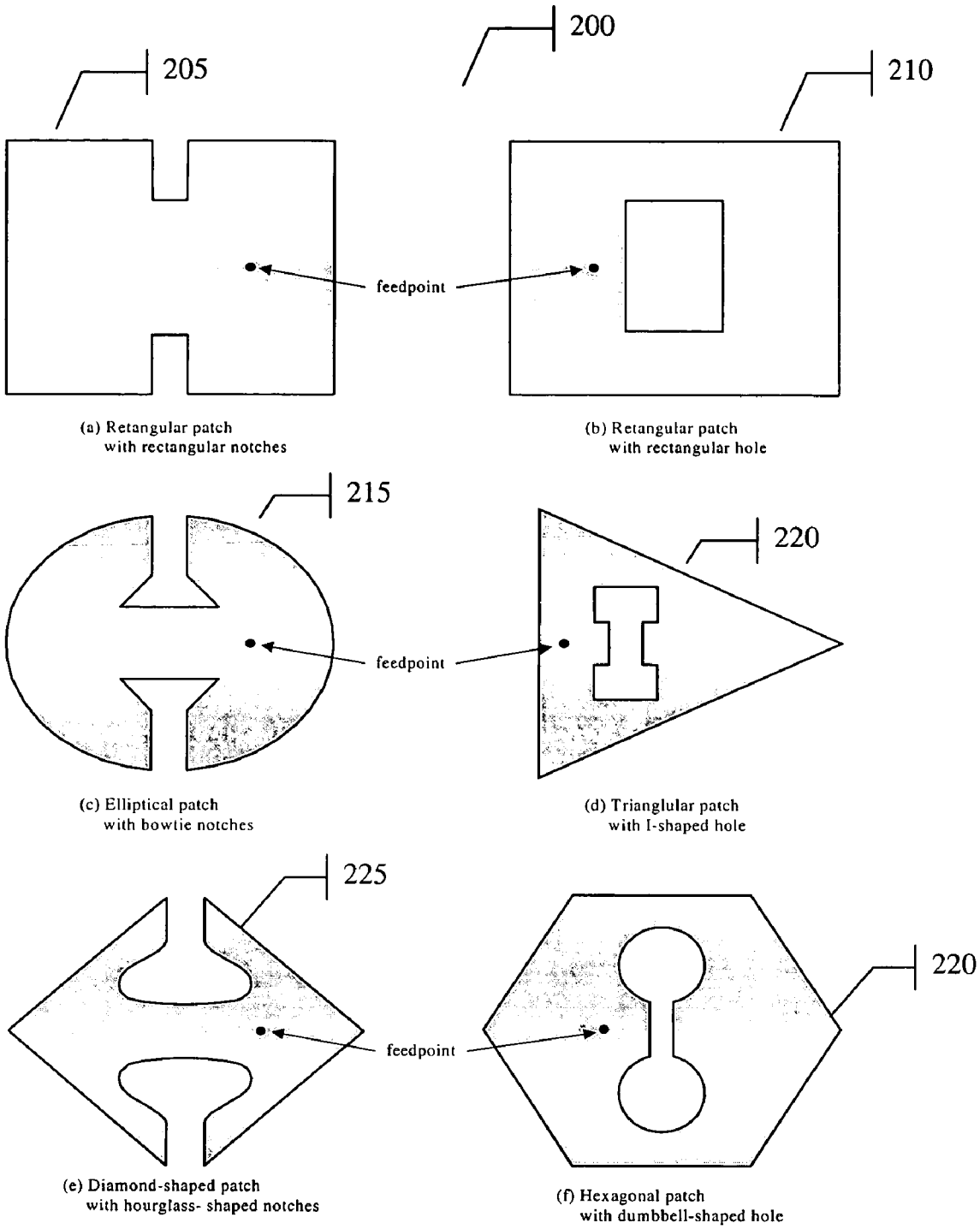
FIG. 2 illustrates a reduced size patch antennas showing a variety of patch, hole and notch shapes that can be used in the present invention.

Some reduced size geometries are shown in FIG. 2, shown generally as 200. The increase in effective length depends on the strength of the current flow around the obstacles, the size of the obstacles, as well as the total obstacle perimeter length. Generally, a longer obstacle perimeter for similar size obstacles offer a greater size reduction effect, which explains why bow-tie or I-shaped holes and the their "half"-shaped counterparts used as notches are sometimes desirable. Since edge currents are stronger than central currents, notches on the patch's edges generally have a greater effect than holes closer to the centre of the patch. Although the present invention is not limited in this respect, several possible patch shapes include a rectangular patch with rectangular notches as shown at 205; a rectangular patch with rectangular hole as shown at 210; an elliptical patch with bowtie notches as shown at 215, a triangular patch with I-shaped hole as shown at 220; a diamond shaped patch with hourglass-shaped notches as shown at 225; and, a hexagonal patch with dumbbell-shaped hold as shown at 220.

Reducing the size of the patch in any way usually leads to a reduction in bandwidth. Since bandwidth is related to the effective volume occupied by the antenna element, and the aim here is to reduce the footprint area of the element, the only way to recuperate bandwidth again is to increase the height of the element volume. The most effective well-known way to utilize the full element volume with patch elements is to use a stacked configuration of two or more patches.

In a normal stacked patch configuration, the stacked patches may be identical in shape and differ slightly in size. The problem with reduced size stacked elements, is that the electromagnetic coupling between the stacked elements are apparently reduced by the holes or notches, to the point where stacking does not offer any significant improvement in the bandwidth. This is due to the fact that less coupling between stacked patches requires smaller spacing between them to achieve the right coupling balance, and hence the resultant element height/volume as well as the bandwidth is not increased appreciably.

One embodiment of the present invention provides to techniques to improve electromagnetic coupling between such reduced size, stacked elements, which in turn allows for higher stacking geometries and hence increased bandwidth.

Figure 3:
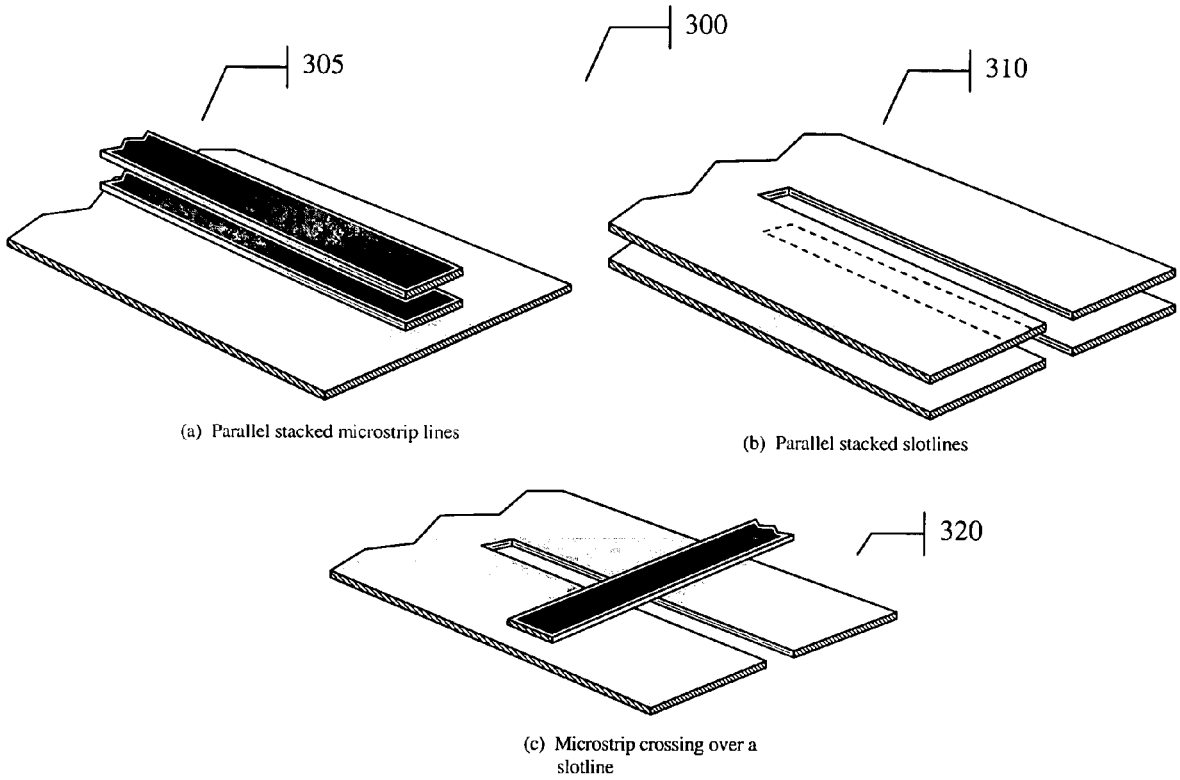
FIG. 3 illustrates a stacked microstrip line and slotline configuration of one embodiment of the present invention.

One important factor to improving the weak electromagnetic coupling between reduced size stacked patches, is to create coupling conditions similar to that of the coupling between a slotline and a microstrip line. It is well known that parallel stacked microstrip lines, or in the dual case, parallel stacked slots in two adjacent ground planes, do not couple very strongly, or at any rate not as strongly as in the case of a microstrip line crossing a slotline at right angles. This is illustrated in FIG. 3 which depicts generally at 300, a stacked microstrip line 305 and slotline configuration 310 of one embodiment of the present invention. The parallel stacked microstrip lines 305 couple by way of magnetic field lines encircling both strips. Similarly, parallel stacked slotlines 310 couple by way of electric field lines encircling both slots. In the case of a conducting strip crossing over a slotline 320 in the ground plane, the slotline blocks the ground plane currents generated by the transverse electromagnetic (TEM) wave propagating along the microstrip line. This creates a charge build-up across the slotline, which launches a TEM wave propagating in both directions along the slotline. This form of slot-strip coupling is very strong and is widely used in microwave circuits.

Figure 3A:
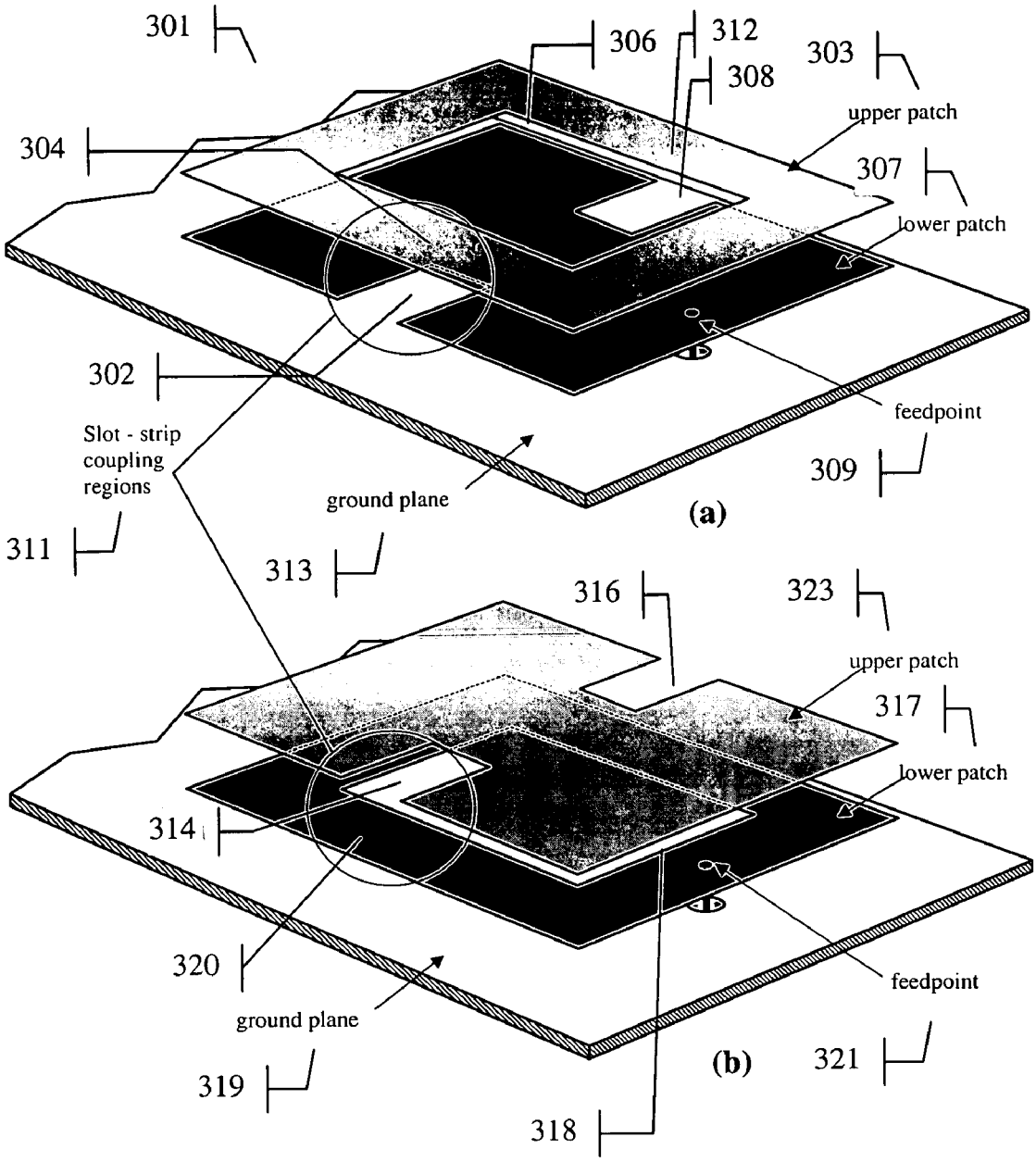
FIG. 3*a* is an illustration of a linearly polarized reduced size stacked patch elements of one embodiment of the present invention.

A stacked pair of reduced size patches of similar shape creates conditions similar to the parallel-coupled microstrip or slotlines, which explains why the coupling is weak. Turning now to FIG. 3*a,* at 301, shows two variations of an embodiment of the present invention where electromagnetic coupling, in slot-strip coupling regions 311, between two stacked patches (upper patch 303 and lower patch 307) are increased greatly due to the fact that strip-like parts 302 of one patch (lower patch 307 in this exemplary embodiment) cross over slot-like parts 304 of the other patch (upper patch 303 in this exemplary embodiment). Ground plane 313 is adjacent to lower patch 307 which includes feedpoint 309 thereon.

In variation (a), the lower patch 307 has notches 302 and 308 on its edges, while the upper patch 303 has a central hole 306. This ensures that the strip-like parts 304 of the upper patch 303 cross over the slot-like notches 302 and 308 of the lower patch 307. At the same time the narrow area between the notches 302 and 308 in the lower patch 307 acts as a strip crossing over the slot-like hole 306 in the upper patch 303. These strip crossing slot regions 311 create strong electromagnetic coupling between the patches.

In variation (b), the upper patch 323 has notches 314 and 316 on its edges, while the lower patch 317 has a central hole 318. This ensures that the strip-like parts 320 of the lower patch 317 cross over the slot-like notches 314 and 316 of the upper patch 323. At the same time the narrow area between the notches 314 and 316 in the upper patch 323 acts as a strip crossing over the slot-like hole in the upper patch 323. These strip crossing slot regions 311 create strong electromagnetic coupling between the patches.

The bandwidth can be increased by increasing the total patch assembly height. If the desirable bandwidth cannot be obtained from two patches alone, extra patches can be added to the stack.

The double stacked patch configuration can be extended to three or more stacked patches, by adding extra patches while making sure that a patch with a hole is followed by a patch with notches and vice versa. This provides that no two adjacent patches will have the same fundamental geometry.

It is understood that although the rectangular patch shapes shown in FIG. 3*a* suffice to explain the operation of the invention, it should be appreciated that the baseline patch shape can be of a different shape other than rectangular, such as, but in no way limited to, elliptical or polygonal with any number of sides. The notch and hole shapes can also be of different shapes to improve the size reduction effect, such as I, H, hourglass, bowtie or dumbbell shaped, similar to some of the variations shown in FIG. 2.

Figure 4:
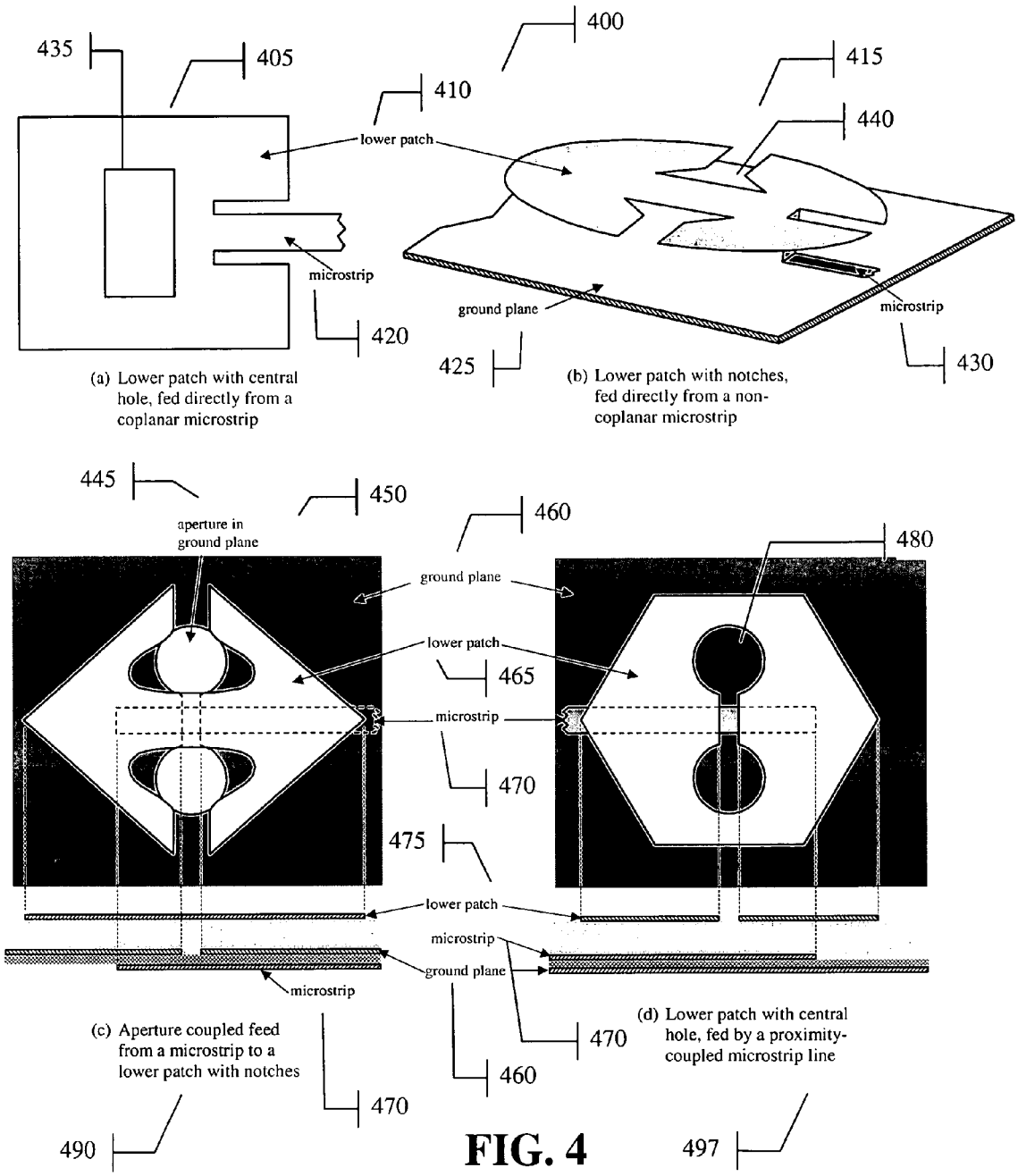
FIG. 4 depicts other excitation techniques for feeding the lower patch of one embodiment of the present invention.

It should also be appreciated that patch excitation techniques other than the feedpin excitation shown in FIG. 3*a* can be used. Although not limited in this respect, the lower patch can also be fed directly by a coplanar or non-coplanar microstrip line or by an aperture coupled technique or by proximity coupling as shown in FIG. 4. FIG. 4 depicted generally at 400, illustrates other excitation techniques for feeding the lower patch of one embodiment of the present invention. A lower patch 405 with central hole 407 may be fed directly from a coplanar micostrip 420 and a lower patch 415 with notches 440 may be fed directly from a non-coplanar micrstrip 430. Ground plane 425 is depicted non-coplanar to lower patch 415.

At 490 is illustrated an aperture 445 coupled feed from a microstrip 470 to a lower patch 465 with notches and ground plane 485. In this embodiment the lower patch is diamond shaped with hourglass shaped notches.

At 497 of FIG. 4 is illustrated a lower patch 465 with central hole 480, fed by a proximity coupled microstrip line 470. Ground plane is illustrated at 460. In this embodiment, the lower patch 465 is hexagonal shaped with dumbbell shaped hole 480.

The design of a linearly polarized stacked patch antenna may require control of the following basic characteristics:

1. Frequency of operation;
2. Minimum bandwidth of operation;
3. Terminating impedance;
4. Maximum overall size.

All four of these specifications may be fixed for certain applications, and the design may need to be flexible enough to satisfy them all. The basic reduced size stacked patch antenna described above however, may have some inherent limitations, which may prevent the design to satisfy all the required specifications at once. These limitations may include:

1. As has been explained before, central holes may not be as effective as notches in reducing the patch size, therefore size reduction would be limited by that which can be achieved by the patch with the central hole.
2. The terminating impedance is proportional to the distance of the feedpoint from the centre of the patch. In a design that may require the lower element to have a hole, the feedpoint may be forced to be near the edge of the patch. This may result in too high of a terminating impedance. Similarly, in a design where the lower patch has notches on the edges, and in addition also needs to have notches on the remaining two edges of the patch for dual polarization applications, the feedpoint is forced to be near the centre of the patch. This may result in too low of a terminating impedance.
3. The only way to control the electromagnetic coupling between the stacked patches once the desired size reduction has been achieved, may be to vary the height separation between them. This may be a problem in applications where there is also a height restriction. Since the height is also proportional to the bandwidth for a given footprint size, the bandwidth will also vary with adjustments in the coupling factor, and in some cases the final bandwidth may be too narrow. An excessively wide bandwidth on the other hand also indicates that the element volume may be unnecessarily large.

The aforemention limitation no. 2 is only a problem in a linearly polarization application when the lower patch has a hole, forcing the feed point to be near the edge. This may be overcome by using a different shaped hole as described above, so there is more freedom in placing the feedpoint. Limitation no. 2 does pose a problem in dual polarization applications, but as described below, the techniques for addressing Limitation 1 and 3 for the linear polarization case will also solve Limitation 2.

Figure 5:
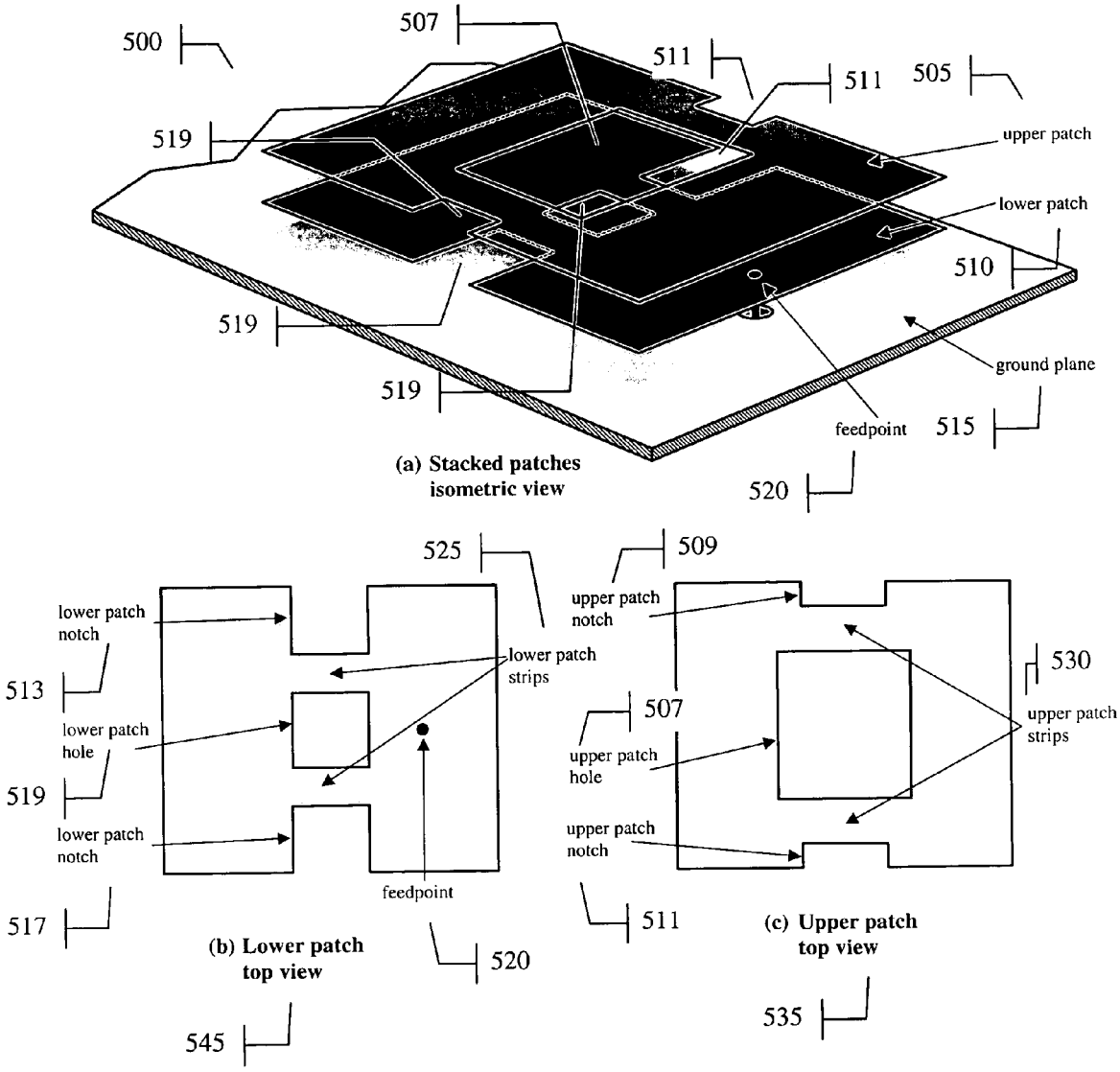
FIG. 5 illustrates a linearly polarized, reduced size stacked patch antenna capable of more flexibility in controlling the design specifications of the present invention.

Turning now to FIG. 5, shown generally in a stacked isometric view at 500, is another embodiment of the present invention capable of solving limitation 1 and 3 above. Both patches in the stacked configuration in this embodiment may now have notches and holes. The upper patch 505 may have a large hole 507 with small notches 509 and 511, therefore its operation is still governed by the hole 507. The lower patch 510 may have deep notches 513 and 517 with a small central hole 519, therefore its operation is still governed by the notches 513 and 517.

The introduction of notches in the parch that previously in the previous embodiment only had a hole, allow for extra size reduction, thereby overcoming Limitation 1. The relative arrangement of the notches and holes in the upper and lower patches also overcomes Limitation 3. In both patches, there are relatively narrow strips between the notch ends and the central holes. These strips are the only paths for the resonant currents to flow from one end of the patch to the other. Since the notches 509 and 511 on the upper patch 505 is much shallower than the lower patch 510, the upper patch strips pass substantially across the notches 513 and 517 of the lower patch 510.

At the same time the lower patch strips pass substantially across the central hole 507 of the upper patch 505. Therefore, strong electromagnetic coupling between the patches are ensured. In addition, the amount of coupling can now be controlled by shifting the strips (by increasing the central hole size at the expense of the notch depths, or vice versa) in each patch so that they pass closer or farther from the associated coupling hole or notch in the other patch. Minimum coupling will occur when the strips in the upper and lower patches are aligned, i.e., when the upper and lower patch geometry are essentially identical. Maximum coupling will occur when the strips in the upper patch are removed as far as possible from the strips in the lower patch, i.e. when the central hole in the bottom patch and notches in the upper patch are removed.

It should be appreciated that the lower and upper patches in this embodiment can be interchanged without changing the basic operation of the reduced stacked patch antenna, since the coupling mechanism does not depend on which patch is placed higher or lower. It should also be noted that although the patch shapes shown in FIG. 5 suffice to explain the operation of the invention, it should be appreciated that the baseline patch shape can be of a different shape other than rectangular, such as, but not limited to, elliptical or polygonal with a different number of sides. The notch and hole shapes can also be of different shapes to improve the size reduction effect, such as, but not limited to, I, H, hourglass, bowtie or dumbbell shaped, similar to some of the variations shown above in FIG. 2. Further, it should be appreciated that patch excitation techniques other than the feedpin excitation shown in FIG. 5 may be used. The lower patch can also be fed directly by a microstrip line, or an aperture coupled technique as illustrated in FIG. 4. A ground plane may be adjacent to lower patch 510 with feedpoint shown at 520.

A top view of lower patch 510 is shown at 545 further depicting the lower patch notches 513 and 517 and lower patch hole 519 and feedpoint 520. A top view of upper patch 505 is shown at 535 further depicting the upper patch notches 509 and 511 and upper patch hole 507 with upper patch strips 530.

Figure 6:
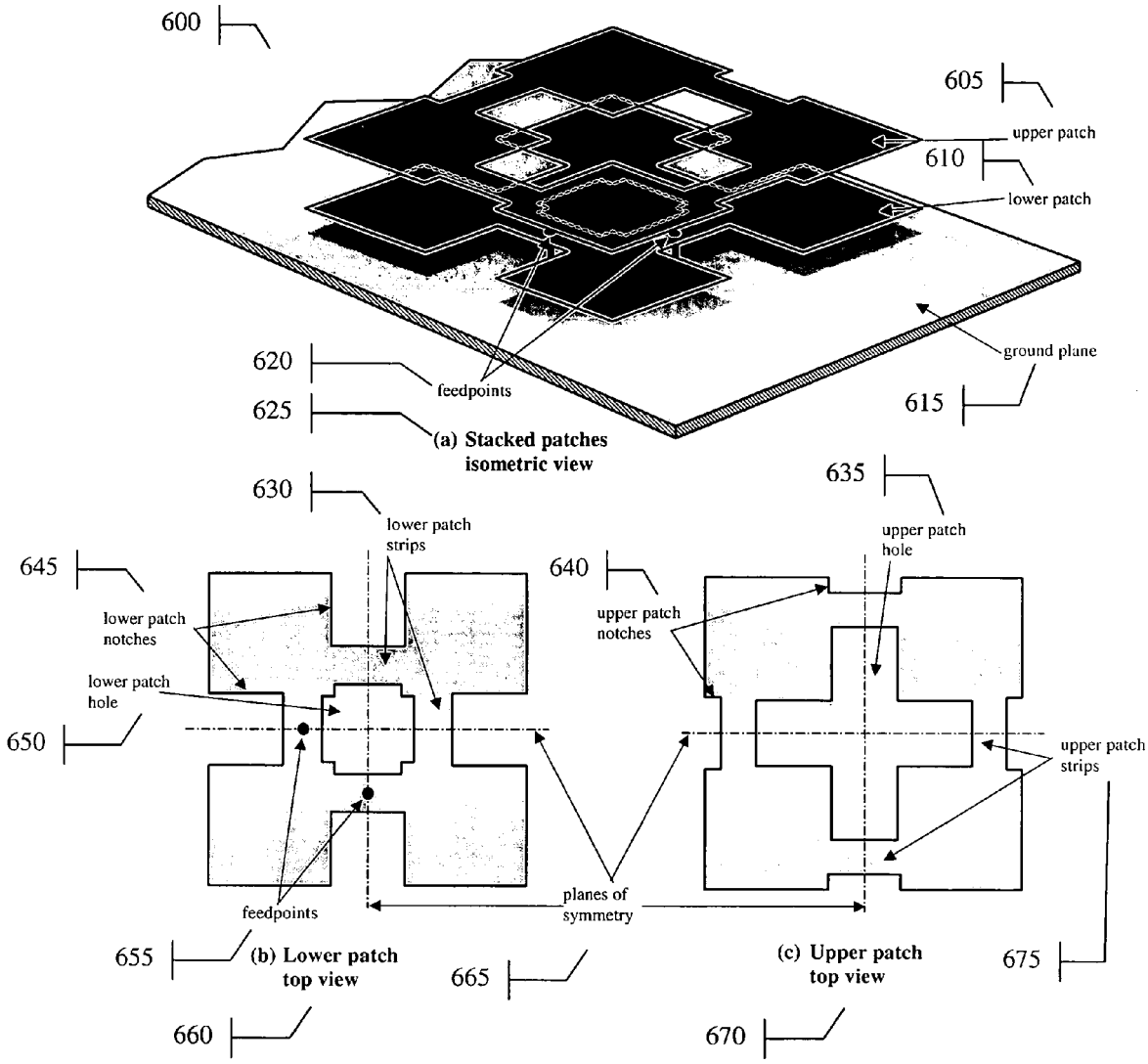
FIG. 6 depicts the dual polarized, reduced size stacked patch antenna using square patches with rectangular notches and crossed-slot holes in one embodiment of the present invention.

Turning now to FIG. 6, generally at 600, is another embodiment of the present invention illustrating in an isometric view a reduced size, dual polarized stacked patch antenna. In order to produce a dual polarized stacked patch antenna, it has to be excited in two orthogonal resonant modes. For good isolation between the two modes, antenna symmetry in one plane orthogonal to the patch ground plane is sufficient. With only one such plane of symmetry, the feed geometry for the two orthogonal resonant modes will be different. For design simplicity, it is therefore desirable to require two orthogonal planes of symmetry with each plane orthogonal to the ground plane. This may allow for the feed geometries to be made identical, saving design time.

Figure 7:
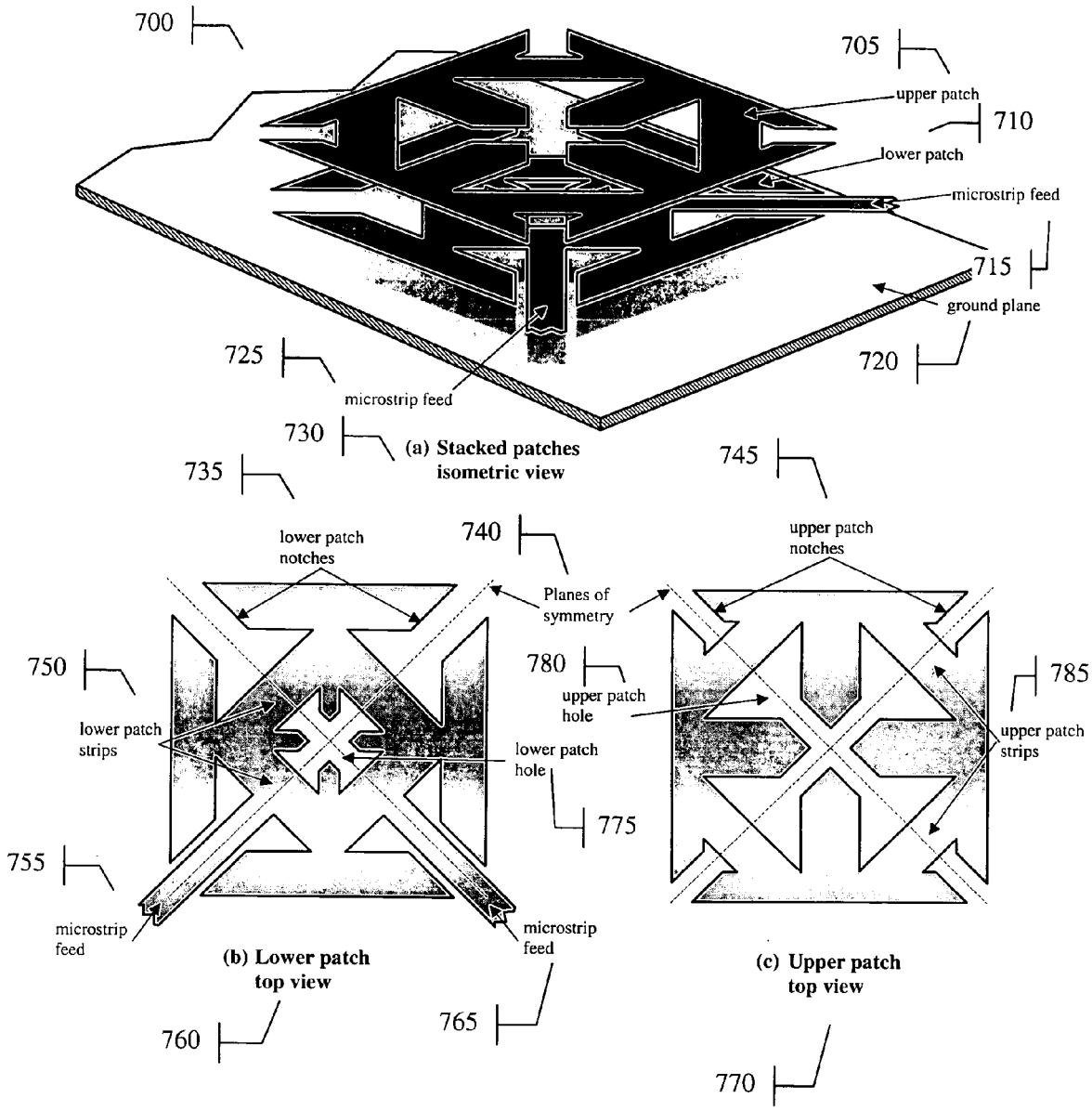
FIG. 7 illustrates a dual polarized, reduced size stacked patch antenna using square patches with bowtie notches and crossed-bowtie shaped holes of one embodiment of the present invention.

Thus, although not limited in this respect, this embodiment of the present invention provides for a reduced size stacked patch antenna, with two orthogonal planes of symmetry. Two variations are shown in FIG. 6 and 7. Size reduction is based on the same techniques described above, but due to the symmetry requirements, extra notches and holes with symmetry in two orthogonal planes may be used instead. The pair of bridging strips that are relevant to a first polarization, still run parallel to each other, flanked by edge-notches and the central hole, similar to the linear polarization case. The other notches and central hole features relevant to the orthogonal second polarization are basically parallel to the first polarization currents, and therefore has by design little effect on them, and do not alter the plane of the first polarization. The two feedpoints in FIG. 6 as well as the microstrip feeds in FIG. 7 are placed in two different orthogonal planes of symmetry. Strictly speaking, the feed geometries shown may destroy the symmetry, but usually the effect on the isolation is negligible. If needed, perfect symmetry may be restored by feeding the lower patch at opposite ends for each polarization, therefore the number of feedpoints are increased to two per polarization. In such a case, the opposing feedpoints may need to be excited in opposite phase.

The solution to Limitation no. 2 described above, which were more applicable to dual polarization applications, can now be explained as follows: Since the lower patch strips are flanked by notches and the central hole, as shown in FIGS. 6 and 7, the effective distance of the feedpoints from the centre of the resonating patch may be varied by increasing/decreasing the depth of the notches and decreasing/increasing the dimensions of the central hole appropriately. In this way, the terminating impedance, which is proportional to the distance of the feedpoint from the centre of the resonating patch, may be adjusted, while the resonant frequency may be kept constant. Once the resonant frequency and the terminating impedance have been adjusted in this way, the appropriated amount of coupling to the upper patch can be adjusted. This is done by changing the upper patch notch depths and central hole dimensions so as to obtain the desirable positioning the upper patch strips relative to the lower patch strips. The bandwidth can be increased by increasing the total patch assembly height and by adding extra patches to the stack, as described above.

Turning now specifically to FIG. 6 is shown at 600 stacked patches in an isometric view. The stacked patches include upper patch 605 and lower patch 610 with feed lines 620 and ground plane 615. At 660 is a lower patch top view with lower patch 610 notches 645, lower patch 610 hole 650 and lower patch 610 strips 630. Planes of symmetry between upper patch 605 and lower patch 610 are illustrated at 665. At 670 is a top view of upper patch 605 which includes upper patch 605 notches 640, upper patch 605 hole 635 and upper patch 610 strips 675.

Turning now to FIG. 7 shown generally as 700 is an isometric view of stacked patches. The stacked patches include upper patch 705 and lower patch 710 with microstrip feed 715 and 725 and ground plane 720. At 760 is a lower patch top view with lower patch 710 strips 750, lower patch 710 notches 735 and lower patch 710 hole 775 with micrstrip fee shown as 755 and 765. Planes of symmetry between upper patch 705 and lower patch 710 are depicted at 740. At 770 is a top view of upper patch 705 with upper patch 705 notches 745 and upper patch 705 hole 780 and upper patch 705 strips 785.

While the present invention has been described in terms of what are at present believed to be its preferred embodiments, those skilled in the art will recognize that various modifications to the disclose embodiments can be made without departing from the scope of the invention as defined by the following claims. Further, although a specific scanning antenna utilizing dielectric material is being described in the preferred embodiment, it is understood that any scanning antenna can be used with any type of reader any type of tag and not fall outside of the scope of the present invention.

What is claimed is:

1. A stacked antenna, comprising:

a first patch including at least one slot part thereon;

a second patch including at least one strip part thereon; and wherein said at least one slot part of said first patch at least partially crosses over or partially crosses under said at least one strip part of said second patch and said first patch is a rectangular patch with at least one rectangular notch and said second patch is a rectangular patch with a rectangular hole.

2. The stacked antenna of claim 1, wherein said at least one slot part is formed by at least one notch in said first patch.

3. The stacked antenna of claim 1, wherein said at least one strip part is formed by at least one hole in said second patch.

4. The stacked antenna of claim 1, further comprising at least one additional patch, said at least one additional patch includes at least one slot part thereon if said at least one additional patch is adjacent to a patch that contains at least one strip part or at least one strip part if said at least one additional patch is adjacent to a patch with at least one slot part thereon.

5. The stacked antenna of claim 1, further comprising a feedpoint associated with said first or said second patch.

6. The stacked antenna of claim 1, further comprising a ground plane adjacent to said first or said second patch.

7. The stacked antenna of claim 1, wherein the area where said at least one slot part of said first patch is substantially over said at least one strip part of said second patch creates a slot-strip coupling region.

8. A stacked antenna, comprising:

a first patch including at least one strip part thereon;

a second patch including at least one slot part thereon; and wherein said at least one strip part of said first patch at least partially crossing over said at least one slot part of said second patch and said first patch is diamond shaped patch with at least one hour glass-shaped notch and said second patch is a hexanonal patch with a dumbbell hole.

9. The stacked antenna of claim 8, wherein said at least one slot part is formed by at least one notch in said second patch.

10. The stacked antenna of claim 8, wherein said at least one strip part is formed by at least one hole in said first patch.

11. The stacked antenna of claim 8, further comprising at least one additional patch, said at least one additional patch includes at least one slot part thereon if said at least one additional patch is adjacent to a patch that contains at least one strip part or at least one strip part if said at least one additional patch is adjacent to a patch with at least one slot part thereon.

12. The stacked antenna of claim 8, further comprising a feedpoint associated with said first or said second patch.

13. The stacked antenna of claim 8, further comprising a ground plane adjacent to said first or said second patch.

14. An apparatus, comprising:

at least one patch antenna including a hole therein forming at least one strip portion thereon; and at least one additional patch antenna including at least one notch therein forming at least one slot portion thereon, said at least one-slot like portion at least partially covering, or at least partially being covered by, said at least one strip portion thereby forming a slot-strip coupling region and wherein said at least one patch is a rectangular patch with at least one rectangular notch and said at least one additional patch is a rectangular patch with a rectangular hole.

15. A method for reducing the size of a patch antenna, comprising:

coupling at least one rectangular patch with at least one additional rectangular patch by forming at least one slot-strip coupling region between said at least one patch and said at least one additional patch, said slot-strip coupling region formed by said at least one patch including a hole therein forming at least one strip portion thereon and said at least one additional patch including at least one rectangular notch therein forming at least one slot portion thereon, said at least one-slot portion at least partially covering, or at least partially being covered by, said at least one strip portion thereby forming said coupling region.

16. The method of claim 15, wherein said at least one slot-strip coupling region is two slot-strip coupling regions.

17. The method of claim 15, further comprising providing a ground plane adjacent to said at least one patch or adjacent to said at least one additional patch.

18. The method of claim 15, further comprising feeding an RF signal to said at least one patch or at least one additional patch via a feedpoint associated with said at least one patch or said at least one additional patch.

19. A stacked antenna, comprising:

a first patch including at least one slot part thereon;

a second patch including at least one strip part thereon; and wherein said at least one slot part of said first patch at least partially crosses over or partially crosses under said at least one strip part of said second patch and said first patch is a diamond shaped patch with at least one hour glass-shaped notch and said second patch is a hexagonal patch with a dumbbell hole.

20. A stacked antenna, comprising:

a first patch including at least one slot part thereon;

a second patch including at least one strip part thereon; and wherein said at least one slot part of said first patch at least partially crosses over or partially crosses under said at least one strip part of said second patch and said first patch is an elliptical patch with at least one bowtie notch and said second patch is a triangular patch with an I-shaped hole.

* * * * *